United States Patent [19]

Moser et al.

[11] 4,022,122

[45] May 10, 1977

[54] PRESSING INSTALLATION FOR A COPYING ARRANGEMENT

[75] Inventors: Kurt Moser, Gerlingen; Reinhold Weigele, Korntal; Wolfgang Pfeil, Kornwestheim, all of Germany

[73] Assignee: Develop KG/Dr. Eisbein and Co., Germany

[22] Filed: Aug. 16, 1974

[21] Appl. No.: 498,236

[30] Foreign Application Priority Data

Aug. 16, 1973 Germany ..... 2341530

[52] U.S. Cl. ..... 100/158 R; 100/169; 100/176; 432/60

[51] Int. Cl.[2] ..... B30B 3/04

[58] Field of Search ..... 100/158, 161–176; 101/247; 226/176, 177; 432/60, 228; 355/3 R, 14, 3 FU; 68/244, 256, 257; 72/240; 219/469, 216; 16/150, 184, DIG. 13; 118/637

[56] References Cited

UNITED STATES PATENTS

| | | | |
|---|---|---|---|
| 122,527 | 1/1872 | King | 68/244 |
| 459,343 | 9/1891 | Wheeler, Jr. | 68/257 |
| 3,240,148 | 3/1966 | Varga | 100/158 R |
| 3,846,151 | 11/1974 | Roteman et al. | 118/637 |
| 3,908,589 | 9/1975 | Bar-on | 432/60 |

*Primary Examiner*—Peter Feldman
*Attorney, Agent, or Firm*—Craig & Antonelli

[57] ABSTRACT

A pressing installation for use with a copying arrangement which installation includes a pair of opposed pressure rollers mounted on shafts mutually inclined toward one another with bearing blocks being provided for supporting the rollers. The bearing blocks are pivotably connected on one side of the pressure rollers by a leaf-spring joint arrangement with an adjustable clamping arrangement being provided on the other side of the pressure rollers for maintaining the bearing blocks in a fixed position. The spring arrangement forms a fixed spring joint free from play between the bearing blocks.

32 Claims, 3 Drawing Figures

PRESSING INSTALLATION FOR A COPYING ARRANGEMENT

The present invention relates to a pressing installation and more particularly to a pressing installation for association with fixing means of a copying machine. The pressing installation of the present invention includes two pressure rollers having shafts inclined toward each other with each of the pressure rollers being supported in a bearing block. The bearing blocks are pivotably connected on one side of the pressure rollers and are braced against one another by spring means on the other side of the rollers.

A pressing installation of the type described hereinabove is to be employed with a copying apparatus, and more particularly, with a dry copying machine wherein an electrophotographic copy is produced which is thereafter fixed by pressing the paper sheet having a colored ink powder thereon between the pressure rollers.

In the operation of a copying machine with a pressing installation, high compressive or pressing pressures on the order of up to 1000 Kg are often times encountered. Such high pressures may result in the pressure rollers being deflected or bent under the load even if the rollers are dimensioned to be very strong.

The aim underlying the present invention essentially resides in improving the pressing installation of a copying machine to ensure that there will be no non-uniform or uneven pressures encountered over the length of the pressing rollers. For this purpose, while in use the shafts of the pressing rollers will be slightly inclined toward one another. The inclination of the shafts is generally less than one degree so that extreme care must be exercised to ensure the accuracy and tightness of the joint to avoid increasing or abolishing of the mutual angular inclination of the shafts by tolerances or play in the joint.

Accordingly, it is an object of the present invention to avoid the shortcomings and disadvantages encountered in prior art pressing installations.

It is a further object of the present invention to provide a pressing installation of the type described hereinabove which is very economical to manufacture and install and yet ensures that a high degree of accuracy in the mutual inclination of the shafts will be maintained.

According to one feature of th present invention, leaf-spring joints are provided and function as pivot connections between the bearing blocks with such joints being free from play. Such leaf-spring joints will permit necessary small movements that may be required very well without the occurrence of any bearing play in the joints. This arrangement will ensure that the fixed angle of inclination between the pressure roller shafts will be maintained to a high degree. Moreover, this construction makes it possible to set the angle of inclination afterwards by simply providing shim disks or washers at the mounting point of the leaf-spring joints.

To increase the safety of the operation of the pressing installation, according to a further feature of the present invention, two superposed leaf springs for each leaf-spring joint are provided.

In one embodiment of the present invention, the leaf springs are covered with covering plates on their backs and fastened thereto with spring adjusting pins and/or screws. The cover plates will provide a limitation as to the degree of movement of the leaf springs with respect to the non-covered area. This type construction ensures that the joint will be restricted so as to carry out only a pure pivoting movement. Such a leaf-spring joint of this type is capable of fully absorbing the tensile or tension forces exerted upon it which corresponds to the force of the tension springs.

According to a further feature of the present invention, the bearing blocks are provided which are connected on the side opposite to the leaf-spring joint by tightening or tension screws with cup spring packages being provided between the head and/or nuts of the screws and the bearing blocks. This arrangement ensures a very compact structure which is particularly advantageous in copying machines since in most cases the space in which such machines will be located is limited. The use of cup spring packages also provide an additional advantage in that the spring characteristics thereof can be adjusted with extreme accuracy to the desired requirements thereby ensuring that the compressive pressure of the rollers will be maintained constantly independently of the spring characteristics or strokes.

To prevent the pressure rollers from striking against one another with relatively loud noises or otherwise colliding with one another after the passage of a paper sheet or the like therebetween, according to a further feature of the present invention, provision is made that adjustable spacers are positioned between the bearing blocks. The spacers are preferably so shaped and positioned in such a manner that the pressure rollers will not abut or press against one another on the one hand, but, on the other hand, will still provide sufficient pressing distance or a path for a pre-specified paper thickness.

According to yet another feature of the present invention, the spacers are constructed in the form of a hollow bolt or screw having a nut screwed thereon, with such nut and screw arrangement enveloping the tightening screws and being positioned between the bearing blocks. By this arrangement, a precise adjustment of the pressure rollers can be effected with the support of the spacers taking place in the area of the bearing blocks which will be loaded with a heavy or strong force or pressure.

According to a further feature of the present invention, the shafts of both pressure rollers will be slightly inclined with respect to the direction of travel of the paper. This constructional arrangement ensures that the entire offsetting angle of inclination of the two pressure rollers will be produced by the two pressure rollers jointly with half of the angle of inclination of each being preferably produced by one pressure roller.

For ready assembly or for replacement of the bearing blocks of a pressure roller, in accordance with the present invention, the bearing blocks may be provided with semi-cylindrical bearing boxes which will face the clamping arrangement on which the bearings of the pressure roller will be positioned.

These and other objects, features, and advantages of the present invention will become more apparent from the following description when taken in connection with the accompanying drawings which show, for the purpose of illustration only, several embodiments of a pressing installation in accordance with the present invention, and wherein.

Figure 1:
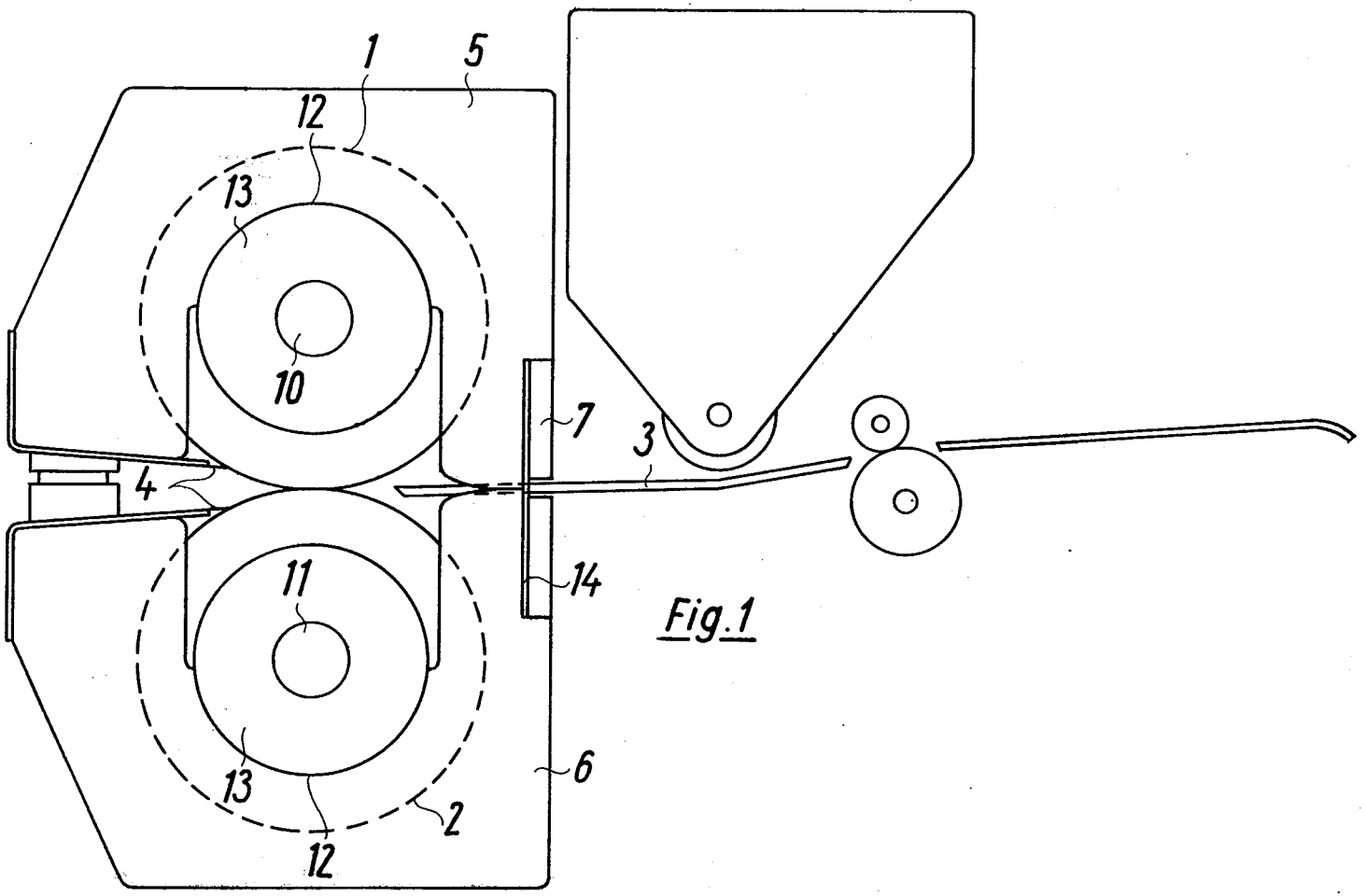
FIG. 1 is a side view of a pressing mechanism in accordance with the present invention.

Referring now to the drawings wherein like reference numerals are used throughout the various views to designate like parts, the pressing installation as shown in FIG. 1 includes two opposed pressure rollers 1, 2 which function as the means for fixing an electrophotographic copy. The pressing installation is a unit of a copying apparatus in which a picture image or the like is transferred as a charge relief onto a coated paper sheet which subsequently receives a fine-grain magnetizable powder thereon by means of a magnetized roller 30 disposed at the bottom of a powder container 31. The paper sheet containing the magnetizable powder is fed by means of the guiding surface element 3 to the pressure rollers 1, 2 with the pressure roller 1 preferably being driven by a suitable drive source (not shown). The pressure rolles 1, 2 may, for example, consists of hard-chrome plated steel rolls which fix the powder to the sheet of paper by pressing the same between the rollers 1, 2 under high pressure which may range, for example, up to 1000 Kg.

In order to ensure the detachment of the sheet of paper from the pressure rollers 1, 2, in spite of the high pressure imposed thereon, wipers 4 are provided. Additionally, provision is made, in a manner not indicated in detail, to coat the surfaces of the pressure rollers 1, 2 by means of a felt piece or the like with a thin film of silicon oil.

The two pressure rollers 1, 2, as shown in FIG. 1, are supported in bearing blocks 5, 6 which are shaped identically and arranged in a mirror-image symmetry with respect to one another. The bearing blocks 5, 6 are connected respectively on one side of the pressure rollers 1, 2 by means of a leaf-spring joint arrangement 7 within the area of the level of the clamping point or nip of the pressure rollers. The bearing blocks 5, 6 are positioned on the opposite side of the leaf-spring joint 7 by means of a clamping or tensioning arrangement which includes tension screws 8 and cup spring packages 9 so that the necessary contact pressure on the paper sheet can be achieved. By the arrangement of the tension screws and cup spring packages 9 opposite the leaf-spring joint 7, the force produced by the cup spring packages to the pressure rollers will be transmitted as a clamping or pressing force approximately in a ratio of 1:2.

To prevent the possibility that pressing will take place in the middle area of the two pressure rollers 1, 2 only, as a result of bending of the rollers due to the high forces applied thereon, the shafts 10 and 11 of the respective rollers 1, 2 are inclined toward each other and each is supported in a slightly oblique or slanting manner with respect to the direction of movement or advance of the paper sheet. By this arrangement, each shaft 10, 11 provides approximately one-half of the angle of inclination toward the path of movement of the sheet.

The bearing blocks 5, 6 are each provided with a semi-cylindrical bearing box or shell 12 for receiving the bearings 13 of the pressure rollers 1, 2 which are supported at both of their ends. The bearing shells 12 are positioned opposite to the clamping point of the two pressure rollers 1, 2. This arrangement of the bearing boxes 12 for the bearings 13 ensures the safe and satisfactory support while at the same time permits the pressure rollers 1, 2 along with their bearings 13 to be readily disassembled after releasing the tightening screws 8 and the leaf-spring joint 7.

Figure 2:
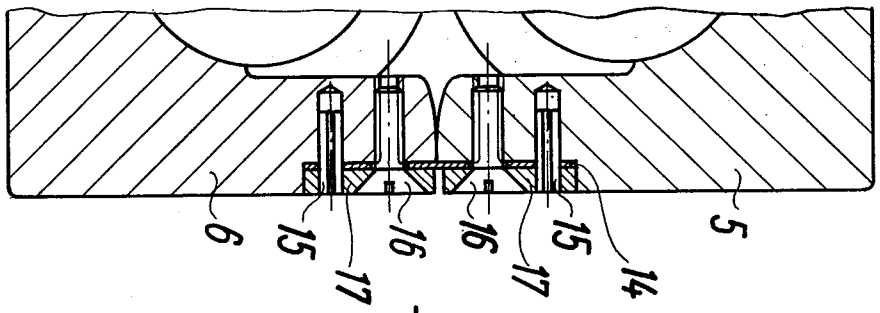
FIG. 2 is a partial cross-sectional view illustrating the leaf-spring joint arrangement according to the present invention.

As shown more clearly in FIG. 2, the leaf-spring joint 7 comprises at least one leaf-spring 14 which connects the two bearing blocks 5, 6 with each other. In most cases, it will be suitable to arrange two such leaf springs 14 one above the other so that a safety feature is provided in case of breakage. The leaf-spring joint 7 has the advantage that it can be constructed substantially free of play so that the offsetting angles in the zone of the bearing boxes 12 can be maintained during practical conditions of normal operation. The leaf-spring joint 7 is provided on both sides of the bearing blocks 5, 6 and on both sides of the guide surface element 3. The leaf springs 14 are each accommodated in recesses provided in the bearing blocks 5, 6 and are mounted with the aid of a spring adjusting pin 15 and screws 16. The back of the springs 14 are covered by cover plates 17 which face one another at a predetermined distance at the engaging end of the two bearing blocks 5, 6. By this construction, the area of the leaf-spring joint 7 in which the leaf springs 14 will be deformed or pivoted is fixed. This arrangement ensures that, except for pivotal motions, no further movements can occur which could lead to an unintended elimination or increase in the angle of inclination of the shafts of the pressing rollers 1, 2. Moreover, by the use of a leaf-spring joint 7, it is possible, by the insertion of shim elements such as disks or washers between the leaf springs 14 and one or both of the bearing blocks 5, 6, the angle of inclination of the shafts of the pressing rollers 1, 2 can be set after the initial operation, such as, for example, when the pressing installation is being serviced.

As noted hereinabove, the clamping force of the two pressure rollers 1, 2 is produced by tightening screws 8 and the cup spring packages 9 which are arranged at both sides of the paper guide. In most instances, it will be sufficient to provide only one cup spring package for the tension screw which, as illustrated, is mounted between the bolt head 18 and the bearing block 5. However, it is understood that it is also possible, if desired, to provide a cup spring package between the nut 19 of the tension bolt or screw 8 and the bearing block 6. The utilization of cup spring packages 9 in the present invention imparts the further advantage that the spring characteristic can be set at will due to the particular choice of a given cup spring. In such a case, a constant spring characteristic can be provided which will be found to be of a particular advantage in the present invention.

Figure 3:
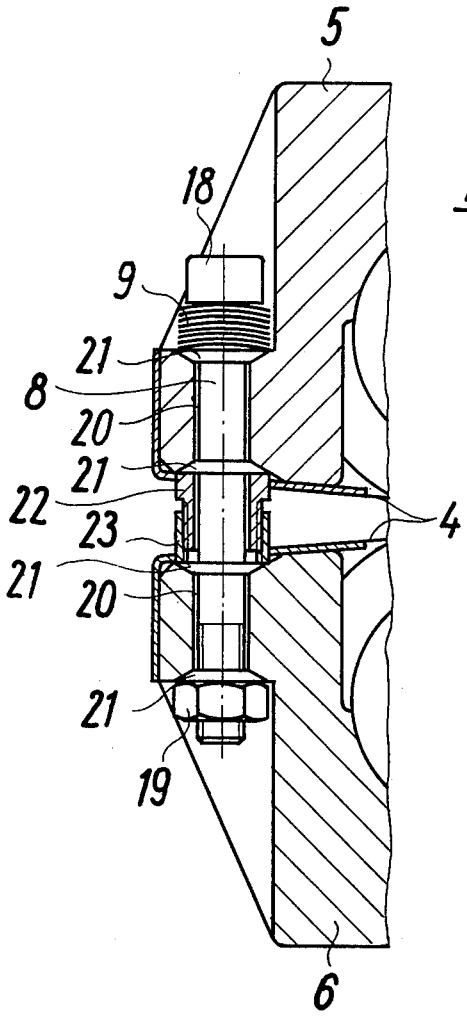
FIG. 3 is partial cross-sectional view of the clamping or tensioning connection disposed opposite the leaf-spring joint arrangement of FIG. 2.

To obtain a satisfactory introduction of the force into the bearing blocks 5 and 6, the ends of the through-holes 20 provided for the tension screw 8 are chamfered or beveled substantially at an angle at 120°. Tumbling disks or swash plates 21 are inserted in the chamfered or beveled ends and are retained in place by the nut 19 or the cup spring packages 9 positioned in the corresponding bearing blocks 5, 6. In operation of the pressing installation of the present invention, it is suitable to provide the two pressure rolls with a certain mutual distance and it is not necessary to operate the rolls direct contact with each other. This constructional arrangement ensures, on the one hand, that the entrance of the paper will be easier, while, on the other hand, the danger that the pressure rollers, after the passage of paper therethrough, will strike each other heavily and noisly will be avoided. In order to maintain the proper distance, spacer elements are provided between the bearing blocks 5, 6. The spacer elements, as shown in FIG. 3, are in the form of a hollow bolt or screw 22 and a nut 23 screwed thereon thereby forming an assembly which surrounds the tension screw 8 and is positioned between the bearing blocks 5, 6. The bolt 22 rests on the bearing block 5 by way of a tumbler disk or swash plate 21 and the nut 23 on the bearing block by a similar plate 21 so that forces are advantageously introduced. The shape and arrangement of the spaces employed in the present invention permits a very accurate adjustment of the distance between the pressure rollers 1, 2 which thereby makes it possible to adjust the pressure rollers afterwards when switching, for example, to a different copying material.

While we have shown and described several embodiments of the present invention, it is understood that the same is not limited thereto but is susceptible of numerous changes and modifications as known to a person skilled in the art, and we therefore do not wish to be limited to the details shown and described herein but intend to cover all such changes and modifications as are encompassed by the scope of the appended claims.

We claim:

1. A pressing installation for a copying arrangement, the installation comprising:

at least two opposed pressure roller means mounted on shafts, bearing block means for supporting each of said pressure roller means with the axis of said shafts being arranged at a mutual angle with respect to each other such that upon application of a pressure on the pressure rollers means, said shafts are inclined toward one another at least at respective end zones thereof, a flat spring joint means disposed on one side of said pressure roller means and extending between the bearing block means for pivotably connecting said bearing block means, means provided at said spring joint means for fixing an area of pivoting of said spring joint means, and means disposed on the other side of said pressure roller means opposite said spring joint means for adjustably securing said bearing block means to each other.

2. An installation according to claim 1, wherein said spring joint means includes at least one leaf-spring mounted to each of said bearing block means.

3. An installation according to claim 2, wherein said leaf-spring is mounted to said bearing block means without play.

4. An installation according to claim 2, wherein each spring joint means includes two superimposed leaf-springs.

5. An installation according to claim 4, wherein said fixing means includes a cover means for covering a side of said leaf-springs facing away from the bearing block means, and means are provided for fastening said cover means.

6. A pressing installation for a copying arrangement, the installation comprising:

at least two opposed pressure roller means mounted on shafts, bearing block means for supporting each of said pressure roller means with said shafts being inclined toward one another, a spring joint means disposed on one side of said pressure roller means for pivotably connecting said bearing block means, each spring joint means including two superimposed leaf-springs mounted to each of said bearing block means, means disposed on the other side of said pressure roller means opposite said spring joint means for adjustably securing said bearing block means to each other, cover means for covering a side of said leaf-springs facing away from the bearing block means, and means for fastening said cover means including adjusting pin means disposed in said leaf-springs and said bearing block means.

7. An installation according to claim 6, wherein said fastening means further includes screw means.

8. An installation according to claim 7, wherein said means for adjustably securing said bearing block means to each other includes a tension bolt means, said tension bolt means including spring means disposed between said bearing block means.

9. An installation according to claim 8, wherein said tension bolt means includes a bolt having a bolt head and a nut, said last-mentioned spring means including at least one cup spring disposed between at least one of the bolt head the bearing block means and between the nut and the bearing block means.

10. An installation according to claim 9, wherein said means for adjustably securing said bearing block means to each other further includes a spacer means disposed between said bearing block means.

11. An installation according to claim 10, wherein said spacer means are adjustable.

12. An installation according to claim 11, wherein each of said spacer means includes a hollow screw and a nut threadably received thereon, and said tension bolt means is disposed within said hollow screw of said spacer means.

13. An installation according to claim 12, wherein the bearing block means are provided with bores for receiving said tension bolt means, and wherein said bores are chamfered for receiving swash plates of said cup springs, the head and nut of said tension bolt means, and said adjustable spacer means.

14. An installation according to claim 13, wherein means are provided for conveying a paper to said pressure roller means, and wherein said shafts of said pressure roller means are inclined in the direction of movement of the paper.

15. An installation according to claim 14, wherein bearings are provided for supporting said pressure roller means, and wherein semi-cylindrical bearing boxes are provided for receiving said bearings, said bearing boxes being disposed in said bearing block means opposite to the nip of said pressure roller means.

16. An installation according to claim 1, wherein said fixing means includes a cover means for covering a side of said spring joint means facing away from said bearing block means, and means are provided for fastening said cover means to said bearing block means.

17. An installation according to claim 1, wherein said means for adjustably securing said block means to each other includes a spacer means disposed between said bearing block means.

18. An installation according to claim 17, wherein said spacer means are adjustable.

19. An installation according to claim 1, wherein means are provided for conveying a paper to said pressure roller means, and wherein said shafts of said pressure roller means are inclined in the direction of movement of the paper.

20. An installation according to claim 1, wherein each of said bearing block means is provided with a recessed portion, said spring joint means being disposed in said portion.

21. An installation according to claim 20, wherein said spring joint means includes at least one leaf spring mounted to each of said bearing block means.

22. An installation according to claim 21, wherein said fixing means includes a cover means for covering a side of said leaf spring facing away from said bearing block means, and means are provided for fastening said cover means to said bearing block means.

23. An arrangement according to claim 22, wherein said means for adjustably securing said bearing block means to each other include an adjustable spacer means disposed between said bearing block means.

24. A pressing installation for a copying arrangement, the installation comprising:

at least two opposed pressure roller means mounted on shafts, bearing block means for supporting each of said pressure roller means with the axis of said shafts being arranged at a mutual angle with respect to each other such that upon application of a pressure on the pressure roller means, said shafts are inclined toward one another at least at respective end zones thereof, a flat spring joint means disposed on one side of said pressure roller means and extending between the bearing block means for pivotably connecting said bearing block means, means provided at said spring joint means for fixing an area of pivoting of said spring joint means, means disposed on the other side of said pressure roller means opposite said spring joint means for adjustably securing said bearing block means to each other, and adjusting fastening means disposed at said spring joint means and said bearing block means.

25. An installation according to claim 24, wherein said means for adjustably securing said bearing block means to each other includes a tension bolt means, said tension bolt means including spring means disposed between said bearing block means.

26. An installation according to claim 25, wherein said tension bolt means includes a bolt having a bolt head and a nut, said lastmentioned spring means including at least one cup spring disposed between at least one of the bolt head and the bearing block means and between the nut and the bearing block means.

27. An installation according to claim 24, wherein said means for adjustably securing said bearing block means to each other includes a spacer means disposed between said bearing block means.

28. An installation according to claim 27, wherein said spacer means are adjustable.

29. An installation according to claim 27, wherein each of said spacer means includes a hollow screw and a nut threadably received thereon, and a tension bolt means is disposed within said hollow screw of said spacer means.

30. An installation according to claim 26, wherein the bearing block means are provided with bores for receiving said tension bolt means, and wherein said bores are chamfered for receiving swash plates of said cup springs, the head and nut of said tension bolt means, and said adjustable spacer means.

31. An installation according to claim 24, wherein means are provided for conveying a paper to said pressure roller means, and wherein said shafts of said pressure roller means are inclined in the direction of movement of the paper.

32. An installation according to claim 24, wheren bearings are provided for supporting said pressure roller means, and wherein semi-cylindrical bearing boxes are provided for receiving said bearings, said bearing boxes being disposed in said bearing block means opposite to the nip of said pressure roller means.

* * * * *